US006178967B1

(12) United States Patent
Barnes, Sr.

(10) Patent No.: US 6,178,967 B1
(45) Date of Patent: Jan. 30, 2001

(54) MOUTH PROTECTOR

(76) Inventor: Carl A. Barnes, Sr., 4819 Royal St., New Orleans, LA (US) 70117-4338

( * ) Notice: Under 35 U.S.C. 154(b), the term of this patent shall be extended for 0 days.

(21) Appl. No.: 09/377,282

(22) Filed: Aug. 13, 1999

(51) Int. Cl.[7] ..... A61C 5/14
(52) U.S. Cl. ..... 128/859; 128/861
(58) Field of Search ..... 128/846, 848, 128/859–862; 602/902

(56) References Cited

U.S. PATENT DOCUMENTS 4,799,500 * 1/1989 Newbury ..... 128/859
5,570,704 * 11/1996 Buzzard ..... 128/848
5,692,521 * 12/1997 Nelson ..... 128/848
5,727,564 * 3/1998 Yannalfo ..... 128/848

* cited by examiner

*Primary Examiner*—Michael A. Brown
(74) *Attorney, Agent, or Firm*—Kenneth L. Tolar

(57) ABSTRACT

A uniquely constructed mouth protector designed to minimize discomfort and speech interference associated with conventional athletic mouthpieces includes a pair of posterior splints for encompassing the posterior teeth. Each posterior splint includes an inner and outer wall, both of which terminate at or near the gum line so as to minimize discomfort to the wearer. The posterior splints may be interlinked with a connecting strip that is disposed behind the anterior teeth and extends across the wearer's palate. The device is designed to protect either the upper or lower posterior teeth while allowing a wearer's tongue to contact the anterior teeth thereby minimally interfering with clear speech.

5 Claims, 1 Drawing Sheet

MOUTH PROTECTOR

BACKGROUND OF THE INVENTION

The following substitute specification is a continuation-in-part of application Ser. No. 08/683,171. The present invention relates to a two-piece mouth protector particularly designed to minimize discomfort and speech interference associated with conventional athletic mouthpieces.

DESCRIPTION OF THE PRIOR ART

Athletes such as football players, boxers, and basketball players typically wear a mouthpiece on the upper teeth that minimizes the impact associated with blows to the jaw, mouth or chin. A conventional mouthpiece includes a substantially U-shaped splint constructed with a moldable plastic. The mouthpiece includes a channel defined by an interior side wall, an exterior side wall and a bottom wall. Typically, the device is preheated allowing a user to bite into the device to form a mold of the teeth within the bottom wall.

Such devices, however, have numerous disadvantages. The interior side walls typically contact the palatal region of the mouth resulting in significant discomfort and gagging. In addition, the channel completely encompasses both the front and rear surfaces of the anterior teeth thereby interfering with speech. Accordingly, certain athletes, such as football quarterbacks, who must speak clearly when communicating signals to teammates, must repeatedly remove the mouthpiece while speaking and reinsert it which is burdensome, inconvenient and exposes both the mouth piece and wearer to germs. Furthermore, each of the above described disadvantages discourage some athletes from wearing mouthpieces thereby resulting in increased frequency of brain and tooth related injuries. The present invention overcomes the above described disadvantages of conventional mouthpieces by providing a mouth protector that minimally interferes with speech, is comfortable to wear and minimizing concussions.

Various mouthpieces and mouthguards exist in the prior art. Most notably, U.S. Pat. No. 4,799,500 issued to Newbury relates to a method and apparatus for treatment of muscle imbalance. The apparatus includes a splint molded from a hard plastic material to fit over the teeth of the lower jaw. The splint includes two arms molded to receive the molar teeth which is interconnected with a central bridge section. The bridge section extends behind the incisors and canine teeth of the lower jar so as to be concealed when the device is worn. The device is designed to prevent direct contact between the molar teeth of the upper and lower jaws and to reposition the molar teeth of the lower jaw relative to the upper jaw to permit movement of the lower jaw in a preferred path. The present invention is distinguishable in that it is designed for either the upper or lower teeth and is designed to protect the teeth and brain from blows thereto. The unique design results in minimal discomfort to the wearer and allows the wearer to speak clearly.

SUMMARY OF THE INVENTION

The present invention relates to a two-piece mouth protector for athletes and others engaging in similar activity. The device comprises a pair of splints each including a posterior portion molded to receive and overlay the upper or lower posterior teeth. Each posterior portion includes an inner and an outer wall both of which cover substantially the entire exterior surface of the teeth while terminating at or a predetermined distance from the gum line so as to minimize discomfort to the wearer. The posterior portions may be interconnected with a strip that is disposed across the wearer's palate and behind the anterior teeth. It is therefore an object of the present invention to provide a mouth protector that is comfortable to wear.

It is another object of the present invention to provide a mouth protector that allows a wearer to speak clearly.

It is yet another object of the present invention to provide a mouth protector that is easy and inexpensive to manufacture. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
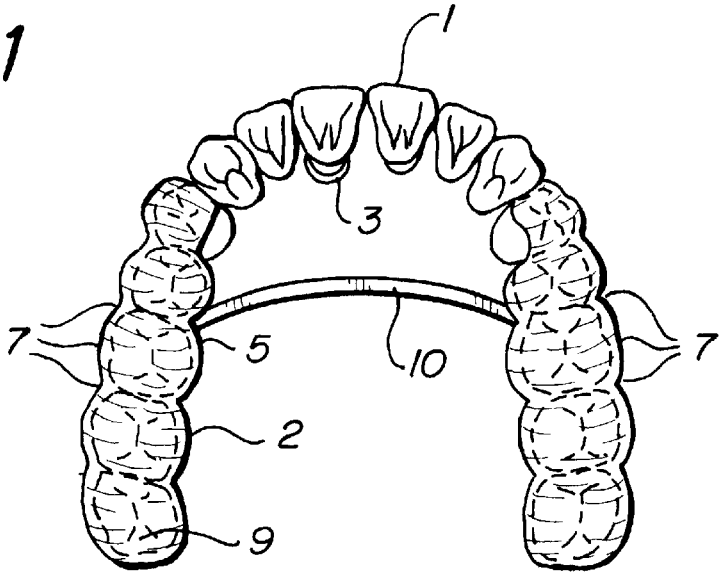
FIG. 1 is a plan view of the upper or lower teeth with the two-part mouth protector mounted thereon.
Figure 2:
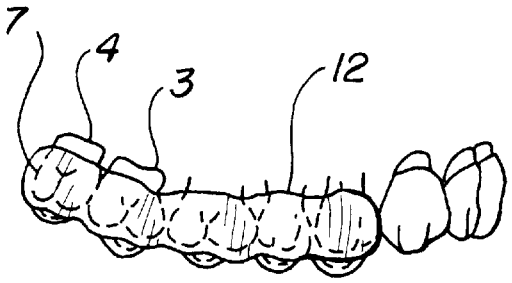
FIG. 2 is a side view of posterior teeth with one of the splints mounted thereon.
Figure 3:
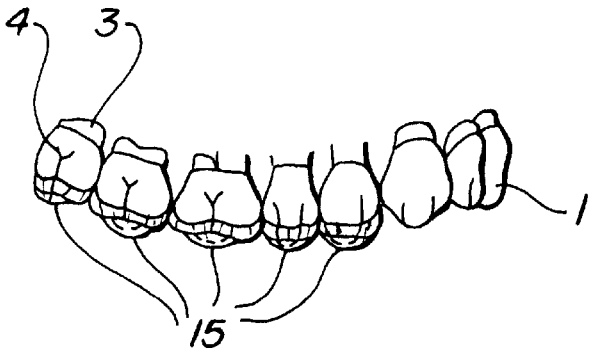
FIG. 3 is a side view of a second embodiment according to the present invention.

Referring now to FIGS. 1 through 3, the present invention relates to a mouth protector designed for protecting either the upper or lower teeth. The upper or lower teeth typically include anterior teeth 1, such as front and lateral incisors and possibly the canine teeth, as well as posterior teeth 4, such as cuspids and molars. The teeth extend into the gums at a point that is sometimes referred to as the gum line 3. Each tooth includes front and rear surfaces with a lower biting surface therebetween.

The mouth protector according to the present invention includes a pair of splints 12 each comprising a posterior portion 2 specifically molded to receive and overlay the posterior teeth. The posterior portion includes an inner wall 5, an outer wall 7 and a bottom wall 9 therebetween. The bottom wall is molded to conform to the biting surface of the posterior teeth. The inner and outer walls of each splint terminate at, or just before, the gum line so that the splint does not contact the palatal region of the mouth thereby minimizing discomfort to the wearer.

Referring now to FIG. 3, a second embodiment is disclosed. The second embodiment includes a bottom wall 15 molded to conform to the biting surface of the posterior teeth. In this embodiment, the inner and outer walls are omitted and the splint overlays only the biting surface. In either embodiment, the splints may be interconnected with a connecting strip 10 that is concealably disposed behind the anterior teeth and extends across the posterior palate to prevent the two splints from becoming separated, and to allow for clear speech.

The above described device is preferably constructed with a resilient conformable thermoplastic material such as that manufactured under the trademark ELVAX® or any other similar equivalent. The splints may also be constructed with KEVLAR™. A mold is made of the wearer's upper or lower teeth so that the mouthpiece according to the present invention can be molded according thereto and according to the details of construction enumerated above.

As is readily apparent from the above description, the present invention provides a mouth protector that protects the wearer's teeth while exposing the anterior teeth allowing the tongue to engage the anterior teeth during speech. Furthermore, the device is considerably more comfortable than conventional mouth protectors.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A mouth protector for securing to the posterior teeth of a wearer, each posterior tooth including a crown portion that terminates at a gum line, said mouth protector comprising:

a pair of splints each molded to conform to and surround the posterior teeth, said splints each including an inner wall and an outer wall, said inner and outer walls each terminating at the gum line so as to minimize discomfort to the wearer.

2. A mouth protector according to claim 1 wherein said splints are interconnected with a strip concealably disposed behind a wearer's anterior teeth and extends across a wearer's palate.

3. A mouth protector for securing to the posterior teeth of a wearer, each posterior tooth including a crown portion that terminates at a gum line, said crown portion having a lower biting surface said mouth protector comprising:

a pair of splints each molded to conform to and overlay only the biting surface of the posterior teeth.

4. A mouth protector according to claim 2 wherein said splints are interconnected with a strip concealably disposed behind a wearer's anterior teeth and extends across a wearer's palate.

5. A mouth protector for securing to the posterior teeth of a wearer, each posterior tooth including a crown portion that terminates at a gum line, said mouth protector comprising:

a pair of splints, each splint molded to conform to and surround the posterior teeth, said splints each including an inner wall and an outer wall, said inner and outer walls each terminating immediately beneath the gum line so as to minimize discomfort to the wearer.

* * * * *